US006171167B1

(12) United States Patent
Perkitny et al.

(10) Patent No.: US 6,171,167 B1
(45) Date of Patent: Jan. 9, 2001

(54) CURRENCY BANK

(75) Inventors: Jerzy Perkitny, Bay Village; William J. Knox, Painesville, both of OH (US)

(73) Assignee: Mag-Nif Incorporated, Mentor, OH (US)

( * ) Notice: Under 35 U.S.C. 154(b), the term of this patent shall be extended for 0 days.

(21) Appl. No.: 09/400,786

(22) Filed: Sep. 22, 1999

Related U.S. Application Data

(63) Continuation-in-part of application No. 29/100,830, filed on Feb. 10, 1999.

(51) Int. Cl.[7] ..... A45C 1/12
(52) U.S. Cl. ..... 446/8; 472/72; 472/137
(58) Field of Search ..... 446/71, 73, 8; 472/64, 69, 71, 72, 77, 137

(56) References Cited

U.S. PATENT DOCUMENTS

| | | | | |
|---|---|---|---|---|
| 453,201 | * | 6/1891 | Miklas | 472/71 |
| 783,203 | * | 2/1905 | Horrocks | 472/71 |
| 927,748 | * | 7/1909 | Oleson | 472/71 |
| 2,694,571 | * | 11/1954 | Reynolds et al. . | |
| 2,914,885 | * | 12/1959 | Milligan | 472/69 |
| 2,922,249 | * | 1/1960 | Zion | 472/69 |
| 3,091,887 | * | 6/1963 | Shook | 472/71 |
| 3,243,914 | * | 4/1966 | Poynter | 472/71 |
| 4,346,851 | * | 8/1982 | Bernardi et al. . | |
| 4,357,528 | * | 11/1982 | Smith et al. . | |
| 4,454,204 | | 6/1984 | Posey . | |
| 4,565,364 | * | 1/1986 | Kondo | 472/69 |
| 4,884,679 | | 12/1989 | Graef et al. . | |
| 4,914,998 | * | 4/1990 | Barla | 83/165 |
| 4,984,782 | * | 1/1991 | Riiger | 472/8 |
| 5,301,618 | | 4/1994 | Abendschein et al. . | |
| 5,325,952 | * | 7/1994 | McGinley et al. | 194/203 |
| 5,722,332 | | 3/1998 | Fumanelli . | |

* cited by examiner

*Primary Examiner*—John Ricci
(74) *Attorney, Agent, or Firm*—Fay, Sharpe, Fagan, Minnich & McKee, LLP

(57) ABSTRACT

A currency bank includes a housing having an inlet and an opening. A shredded currency mechanism is located in the housing and selectively appears in the opening. A feed mechanism is provided for feeding associated currency into the housing at the inlet. A motor powers the shredded currency mechanism and the feed mechanism. A timing assembly is provided for activating the shredded currency mechanism when the feed mechanism is activated by an associated piece of currency so that it appears that the associated currency being fed into the housing is being shredded.

32 Claims, 12 Drawing Sheets

CURRENCY BANK

This application is a continuation-in-part of design patent application Ser. No. 29/100,830 filed on Feb. 10, 1999 and still pending.

BACKGROUND OF THE INVENTION

The present invention relates to a currency bank. More particularly, the instant invention relates to a novelty type currency bank in which it appears as if currency that is being fed into the bank is shredded whereas, in reality, it is held in a currency compartment in the bank.

A need has existed for a novelty bank in which currency that is fed into the bank appears to be shredded but in reality is stored.

Accordingly, it has been considered desirable to develop a new and improved currency bank which would meet the above-stated needs and others.

BRIEF SUMMARY OF THE INVENTION

The present invention relates to a currency bank.

More specifically, the instant invention comprises a currency bank having a housing with an inlet and an opening. A shredded currency mechanism is located in the housing and selectively appears in the opening. A feed mechanism is provided for feeding associated currency into the housing at the inlet. A timing assembly is provided for activating the shredded currency mechanism when the feed mechanism is activated so that it appears that the associated currency being fed into the housing is being shredded.

Preferably, the shredded currency mechanism comprises a motor, a gear train coupled to the motor and a belt assembly operatively connected to the gear train. Preferably, the belt assembly comprises a pair of belts and a plurality of gears around which the pair of belts is looped. If desired, the plurality of gears can comprise a spaced upper pair of gears mounted on a first common shaft and a spaced lower pair of gears mounted on a second common shaft. The shredded currency mechanism can further comprise a cross bar connected to the pair of belts and a shredded currency element secured at one end to the cross bar.

Preferably, the motor comprises an electric motor and there is also provided a source of electric power for the motor. If desired, the source of electric power can comprise batteries located in a battery compartment in the housing.

If desired, a speaker can be located in the housing wherein the timing mechanism also activates the speaker. Also, if desired, a photograph holder can be located on the housing. Preferably, a currency compartment is located in the housing for holding associated currency after it has passed through the feed mechanism. A door located on the housing provides access to the currency compartment.

Preferably, the timing assembly comprises a control circuit, a first timing element for actuating the feed mechanism and a second timing element for deactivating the shredded currency mechanism. If desired, the first timing element can comprise a finger located in a currency inlet slot of the housing. The second timing element can comprise a protrusion located on an element of the shredded currency mechanism.

In another aspect of the present invention, a method of operating the currency bank is provided.

More particularly, in accordance with this aspect of the invention, the method comprises the steps of providing a housing having an inlet in a currency compartment and feeding a piece of currency into the inlet. A shredded currency element is moved past the window in the housing. Thereafter, the piece of currency is deposited into the currency compartment.

One advantage of the present invention is the provision of a novelty currency bank.

Another advantage of the present invention is the provision of a novelty currency bank in which currency that is pulled into the bank appears to be shredded but is, in reality, deposited into a currency compartment in the bank.

Still another advantage of the present invention is the provision of a timing mechanism in a currency bank which starts the motion of a piece of shredded currency past a window at the same time that a piece of currency is fed into an inlet slot of the currency bank.

Yet another advantage of the present invention is the provision of a novelty currency bank with a speaker and a voice chip so that an audible message is played when a piece of currency is fed into the bank.

A further advantage of the present invention is the provision of a currency bank with a window in which a photograph can be displayed.

A still further advantage of the present invention is the provision of a currency bank which is digitally controlled so as to activate and deactivate an electric motor. The motor serves both to pull currency into the bank and to start the motion of a piece of shredded currency past a window in the bank. Preferably, switches are used to activate and deactivate the motor.

Still other benefits and advantages of the present invention will become apparent to those of average skill in the art upon a reading and understanding of the following detailed specification.

BRIEF DESCRIPTION OF THE DRAWINGS

The invention may take form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENTS

Figure 1:
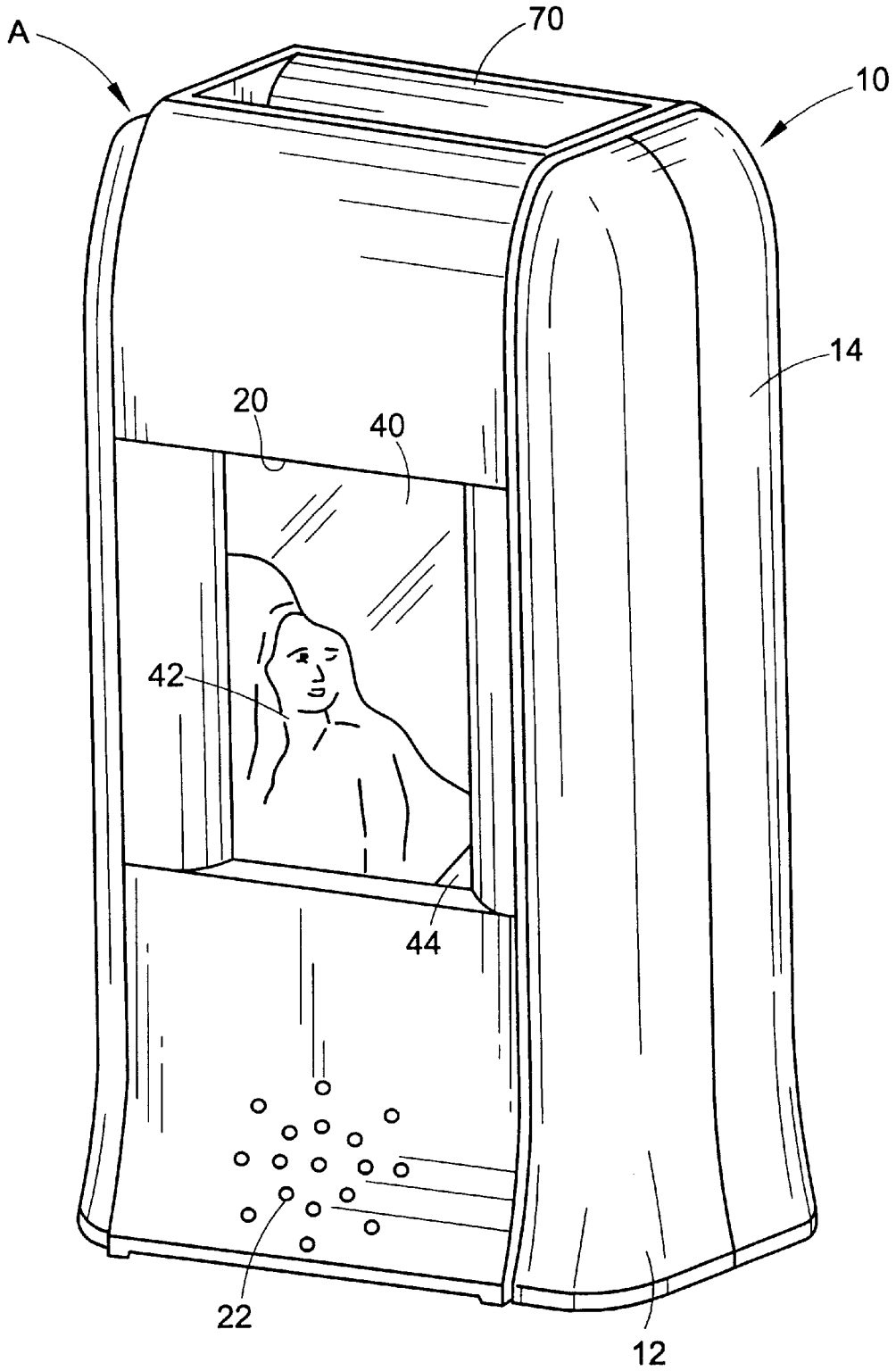
FIG. 1 is a perspective view of a currency bank according to a preferred embodiment of the present invention, with a part partially broken away for clarity.
Figure 8:
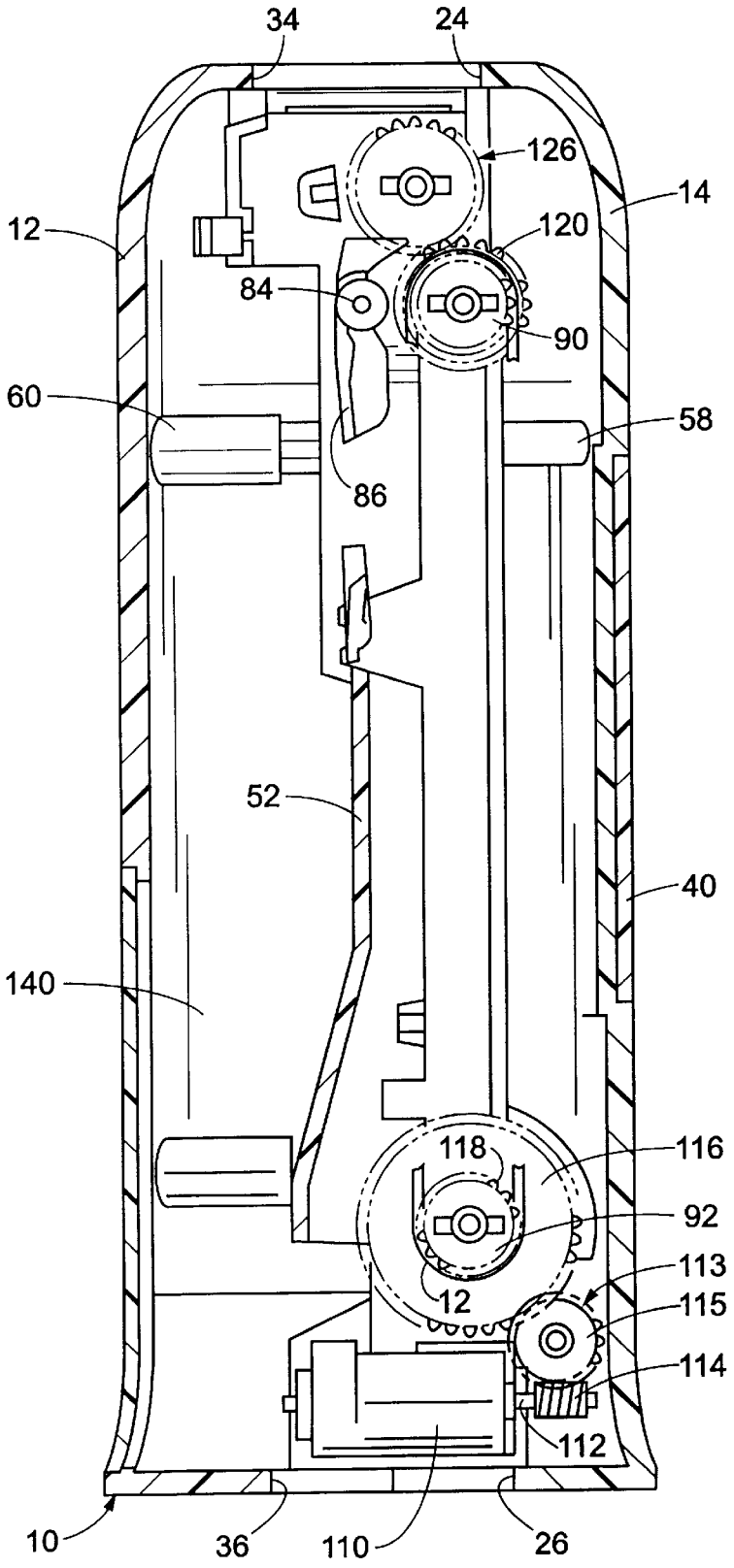
FIG. 8 is a left side cross sectional view of the currency bank of FIG. 1.

Referring now to the drawings wherein the showings are for purposes of illustrating preferred embodiments of the present invention only and not for purposes of limiting same, FIG. 1 illustrates a currency bank A having a housing 10 with a first half 12 and a second half 14. A picture opening 20 is provided in the first half 12. Also, spaced from the picture opening are a plurality of speaker apertures 22 which comprise a speaker grille. As shown in FIG. 8, a top indentation 24 is located on the first half along with a bottom indentation 26.

Figure 6:
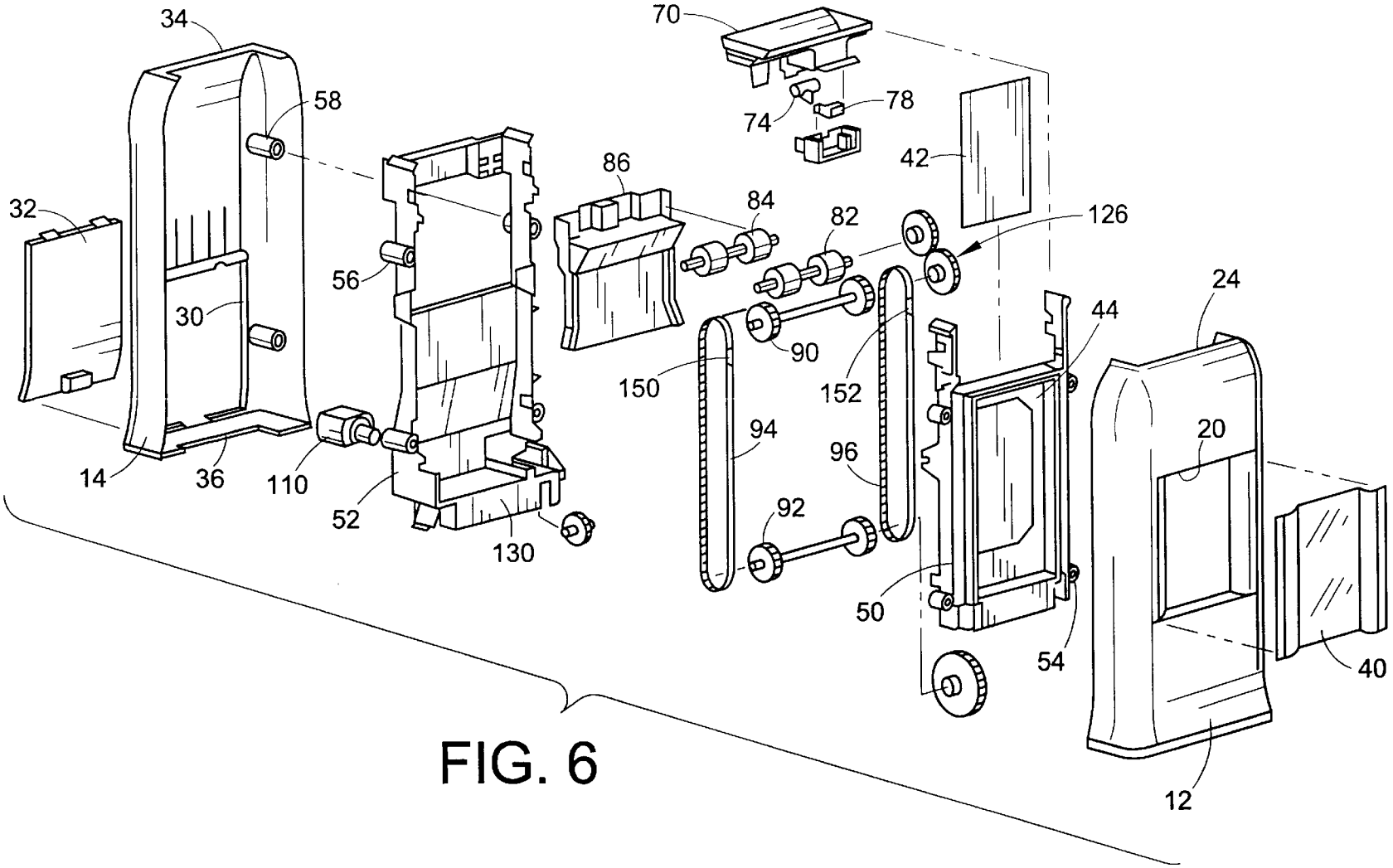
FIG. 6 is an exploded perspective view of the currency bank of FIG. 1.

With reference now to FIG. 6, the second half 14 comprises a currency compartment opening 30 which is covered by a selectively openable door 32. Also provided is a top indentation 34 and a bottom indentation 36.

Covering the picture opening 20 and the housing first half 12 is a window 40. The window is selectively removable so that a user of the currency bank A can position a user selected picture 42 behind the window. To this end, a set of four corners 44 are provided on a first frame 50. The four corners of the picture 42 can be tucked behind the corners 44 so as to secure the picture in place.

Figure 2:
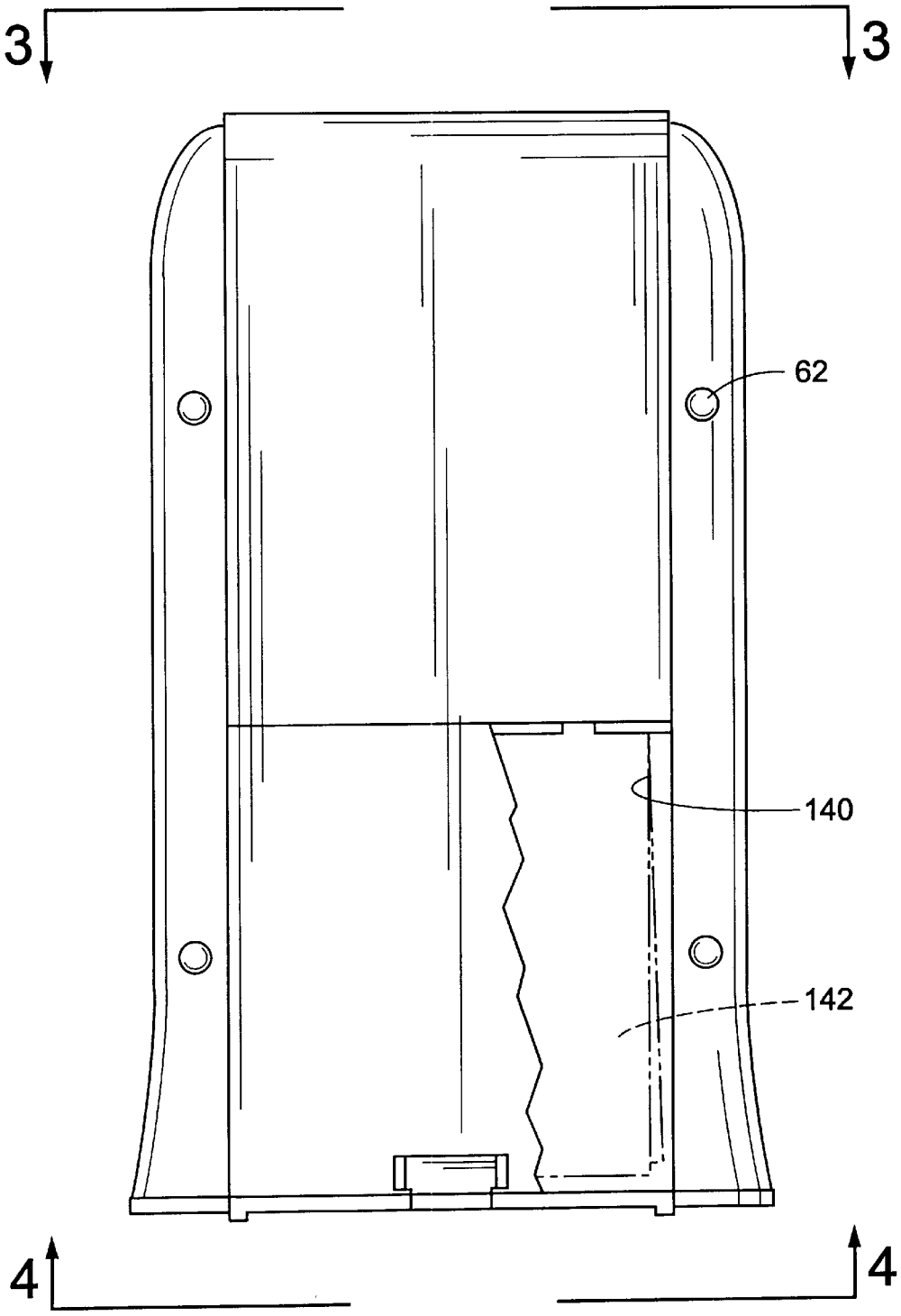
FIG. 2 is a rear elevational view of a currency bank of FIG. 1 with a part partially broken away for clarity.

The front frame 50 is positioned adjacent a main frame 52. These elements are secured together with the first and second housing halves 12 and 14. To this end, a plurality of spaced ears 54 are provided on the front frame. These ears are aligned with spaced ears 56 located on the main frame and mounts 58 located on the second half. Aligned with all of the foregoing ears and mounts are mounts 60 (see FIG. 8) located on the first half. Suitable fasteners 62 (FIG. 2) secure the front frame 50, main frame 52, first half 12 and second half 14 to each other.

Figure 3:
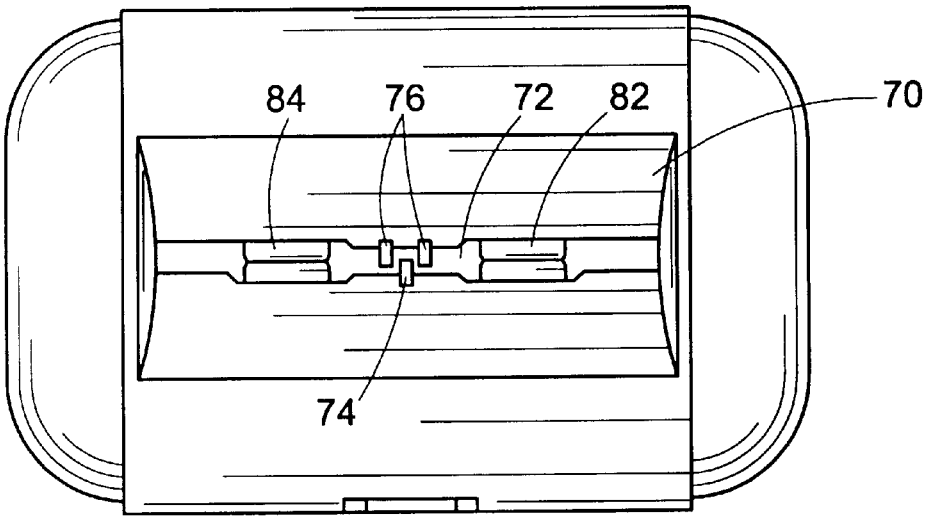
FIG. 3 is a top plan view of the currency bank of FIG. 1.
Figure 7:
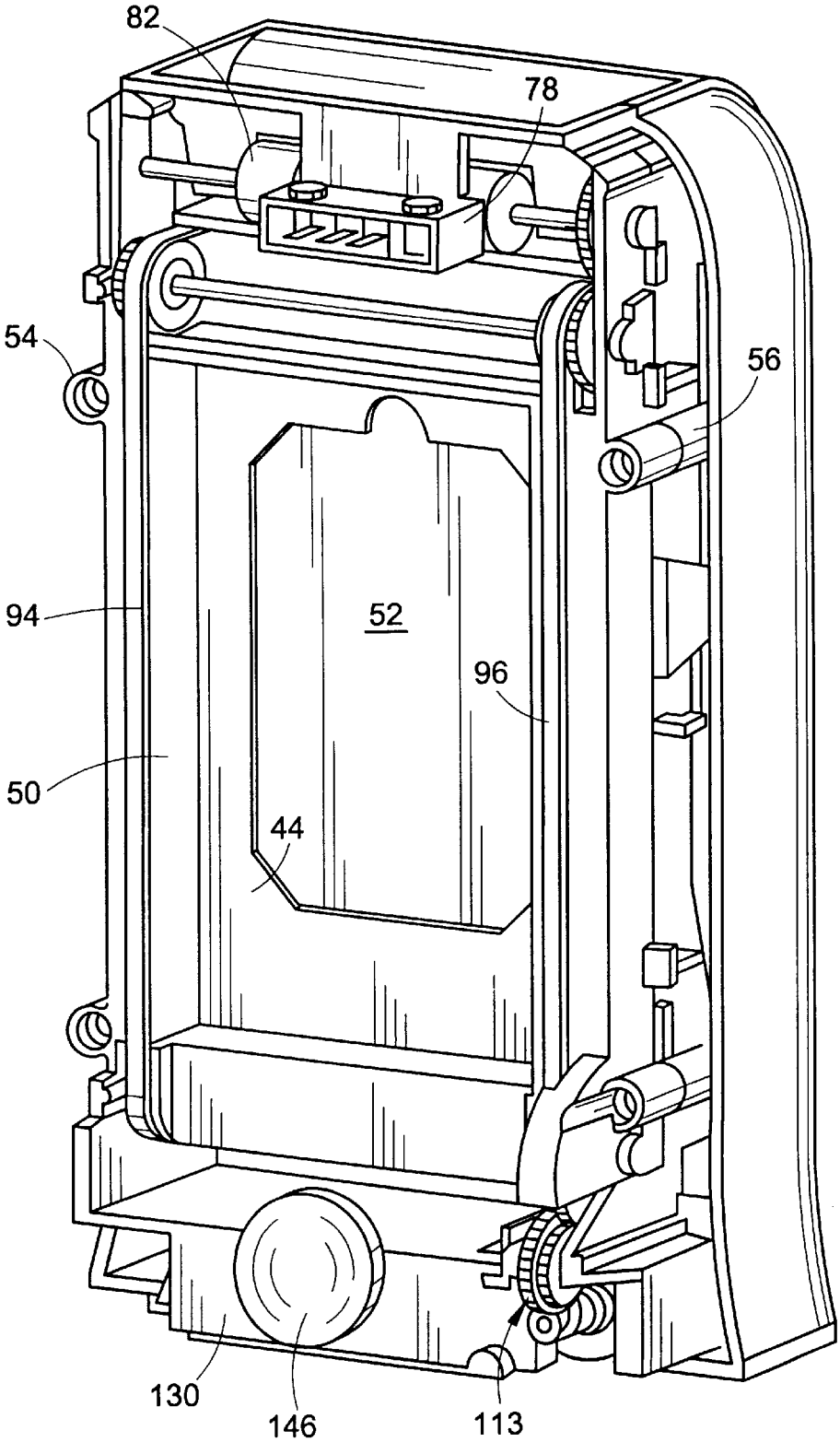
FIG. 7 is a front elevational view of the currency bank of FIG. 1 with a front housing half removed for clarity.

Positioned in the respective top indentations 24 and 34 of the first and second housing halves 12 and 14 is a currency entrance frame 70. With reference now also to FIG. 3, a slot 72 is defined in the entrance frame 70. The slot is sized so as to accommodate a variety of sizes of bills or currency such as U.S. dollars, British pounds, Mexican Pesos and the like. Extending into the slot 72 are a front finger 74 and a pair of rear fingers 76. In the preferred embodiment, the front finger 74 is moveable, whereas the rear fingers 76 are stationary. However, it should be apparent to those of average skill in the art that all of the fingers can be moveable if so desired. Alternatively, the rear fingers 76 could be moveable with the front finger being stationary. With reference now also to FIG. 7, the front finger 74 is wired to a front switch 78. Thus, when the front finger is depressed, the switch is activated. The signal from the front switch is transmitted via suitable wiring to a suitable digital control chip 80 (FIG. 10) located in the housing.

With reference again to FIG. 6, positioned adjacent the switch 78 are a pair of front rollers 82 mounted on a common shaft. The front rollers are rotatably mounted via the shaft on the front frame 50. Located adjacent the front rollers are a pair of rear rollers 84 mounted on a common shaft. The shaft is rotatably mounted on a pusher plate 86. As is evident from FIG. 3, the front and rear rollers 82 and 84 are aligned with each other.

The pusher plate 86 is resiliently biased forward by a spring (not visible) so that the rollers 82 and 84 normally contact each other. They form between them a nip for accommodating a piece of currency.

Figure 5:
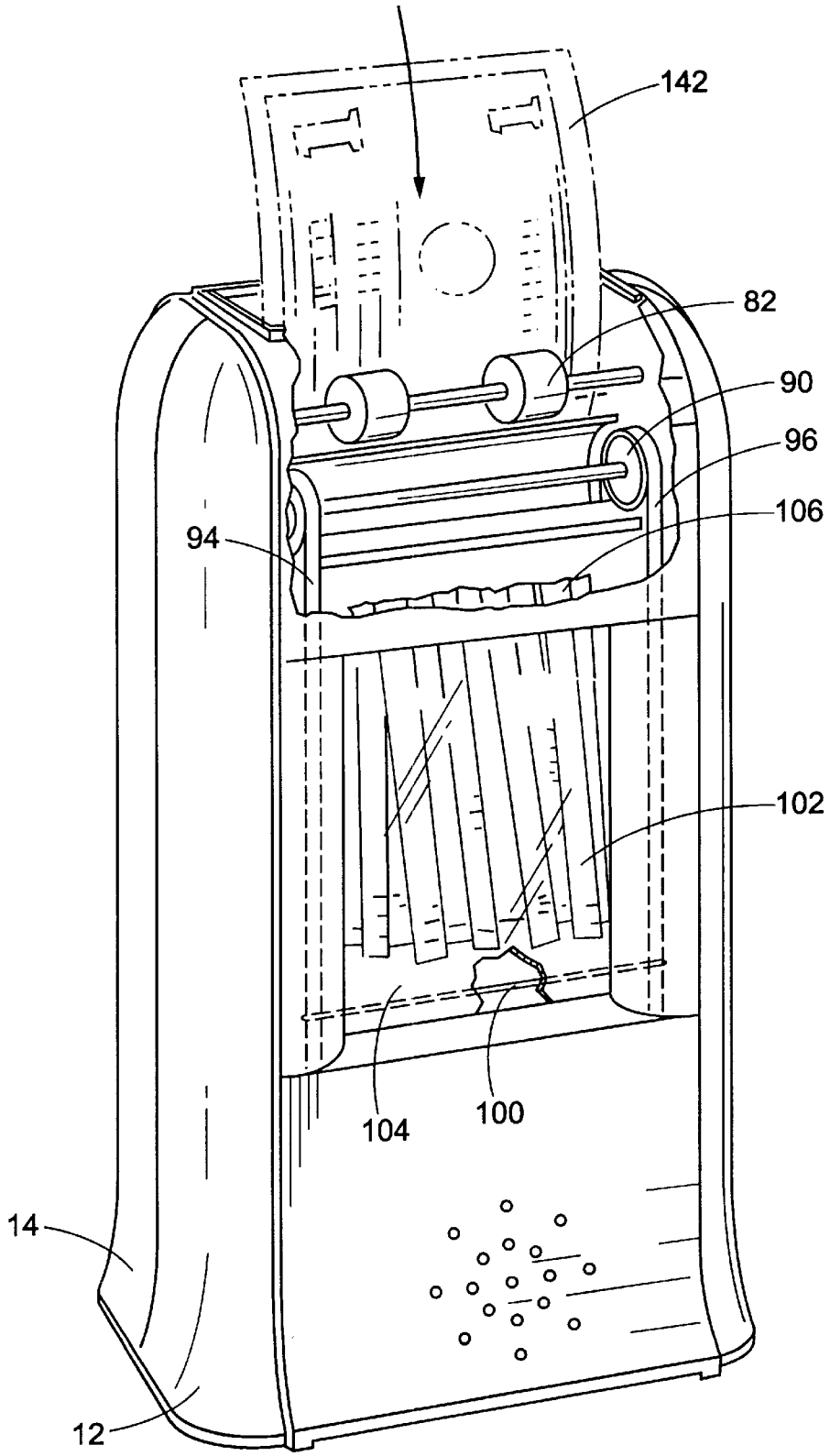
FIG. 5 is a perspective view of the currency bank of FIG. 1 with a part partially broken away for clarity.

Positioned below the sets of rollers 82 and 84 is a pair of spaced upper belt gears 90 mounted on a common shaft. Spaced therefrom is a pair of spaced lower belt gears 92 also mounted on a common shaft. Looped around the upper and lower belt gears 90 and 92 are a left belt 94 and a right belt 96. It is apparent that these belts are endless belts. With reference now also to FIG. 5, a cross bar 100 is mounted on the left and right belts 94 and 96. A piece of shredded currency 102 is secured at a proximal end 104 to the cross bar 100. The proximal end of the shredded currency is looped around the cross bar 100 so as to form a single element. However, a distal end 106 of the currency presents a shredded appearance. The distal end is not secured to the pair of spaced belts.

With reference now again to FIG. 8, a motor 110 is located in the housing 10. The motor includes an output shaft 112 which is connected to a lower gear train 113. The lower gear train 113 comprises a worm gear 114 which is mounted on the output shaft 112, an intermediate gear 115 and a primary drive gear 116. The drive gear 116 is coupled to the lower belt gears 92. The lower gear train 113 drives the pair of belts 94, 96 and, hence, the shredded currency 102. A positive drive is provided. To this end, there are teeth 118 located on the lower belt gears 92 and teeth 120 located on the upper belt gears 90. These teeth engage corresponding teeth 122 on the belts 94 and 96.

Coupled to the shaft of upper belt gears 90 is an upper gear train 126. With reference again to FIG. 6, the upper gear train 126 drives the front rollers 82. When the motor 110 rotates the lower gear train 113, and hence, the left and right belts 94 and 96, the upper gear train 126 is also rotated. In this way, the front rollers 82 are correspondingly rotated. The rear rollers 84 are freely rotatable and will move when they are in contact with the moving front rollers 82.

Figure 4:
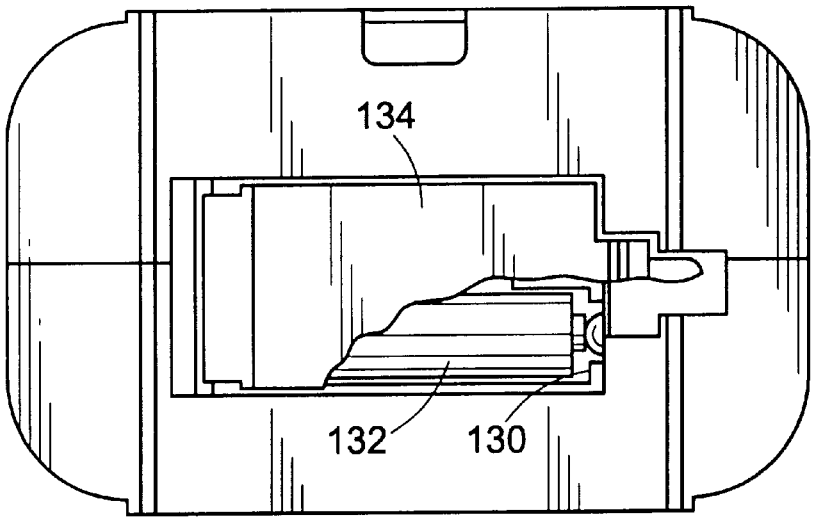
FIG. 4 is a bottom plan view of the currency bank of FIG. 1 with a part partially broken away for clarity.

Preferably, the motor 110 is an electric motor. Electricity is provided for the motor 110 via a battery compartment 130. As is illustrated in FIG. 4, suitable batteries 132 are located in the battery compartment 130. Preferably, a door 134 selectively closes the battery compartment.

With reference again to FIG. 8, a currency storage area 140 is located beneath the front and rear rollers 82 and 84 and somewhat behind them. With reference now to FIG. 5, when a piece of currency 142 is pulled into the housing 10 at the nip formed between the front and rear rollers 82 and 84, the currency is deposited in the storage area 140. At the same time, due to the coordinated movement of the shredded currency 102 via the cross bar 100, when the belts 94 and 96 are actuated, it appears as if the currency 142 is being shredded.

Figure 10:
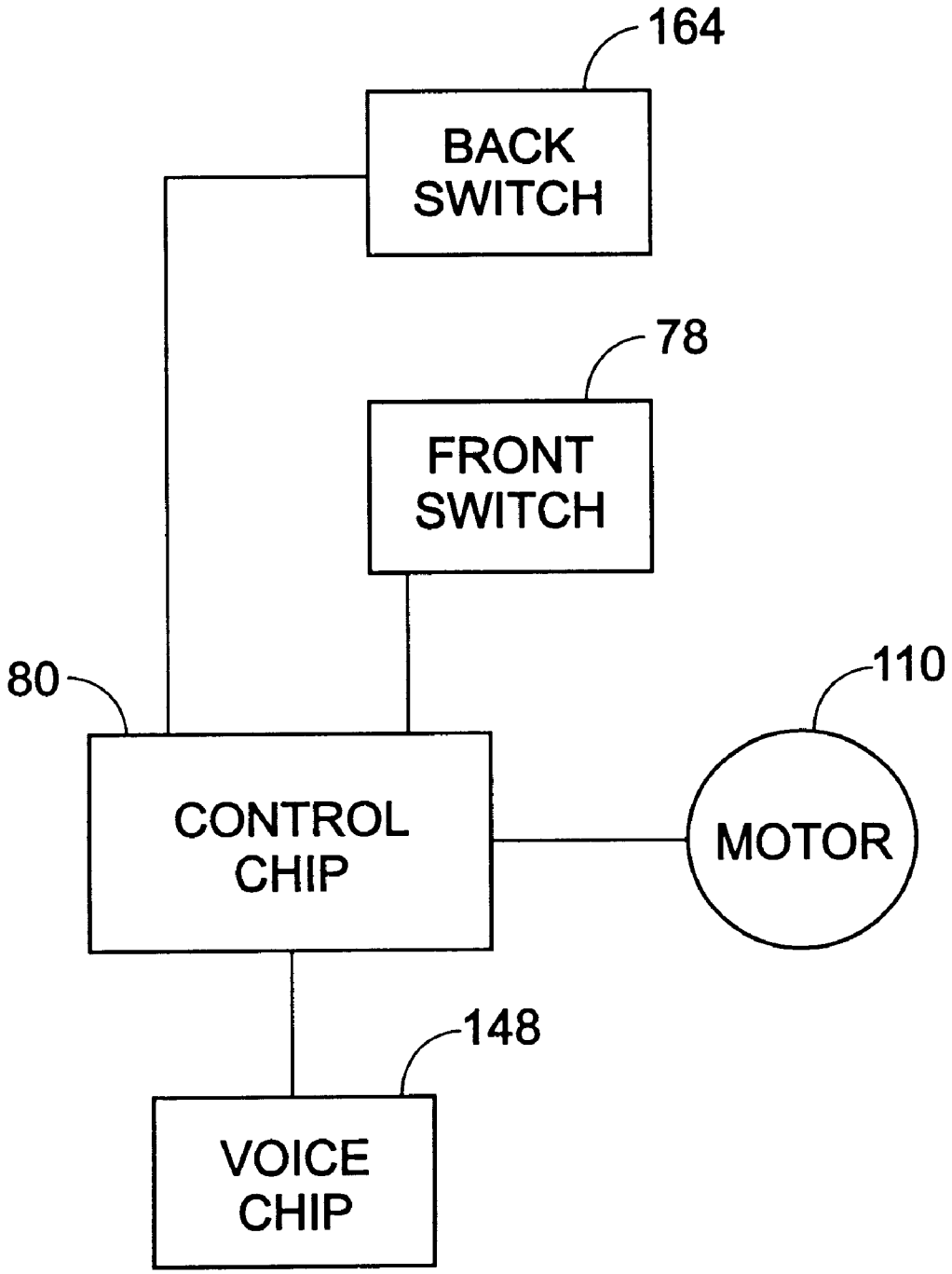
FIG. 10 is a diagrammatic view of the control elements of the currency bank of FIG. 1.
Figure 12:
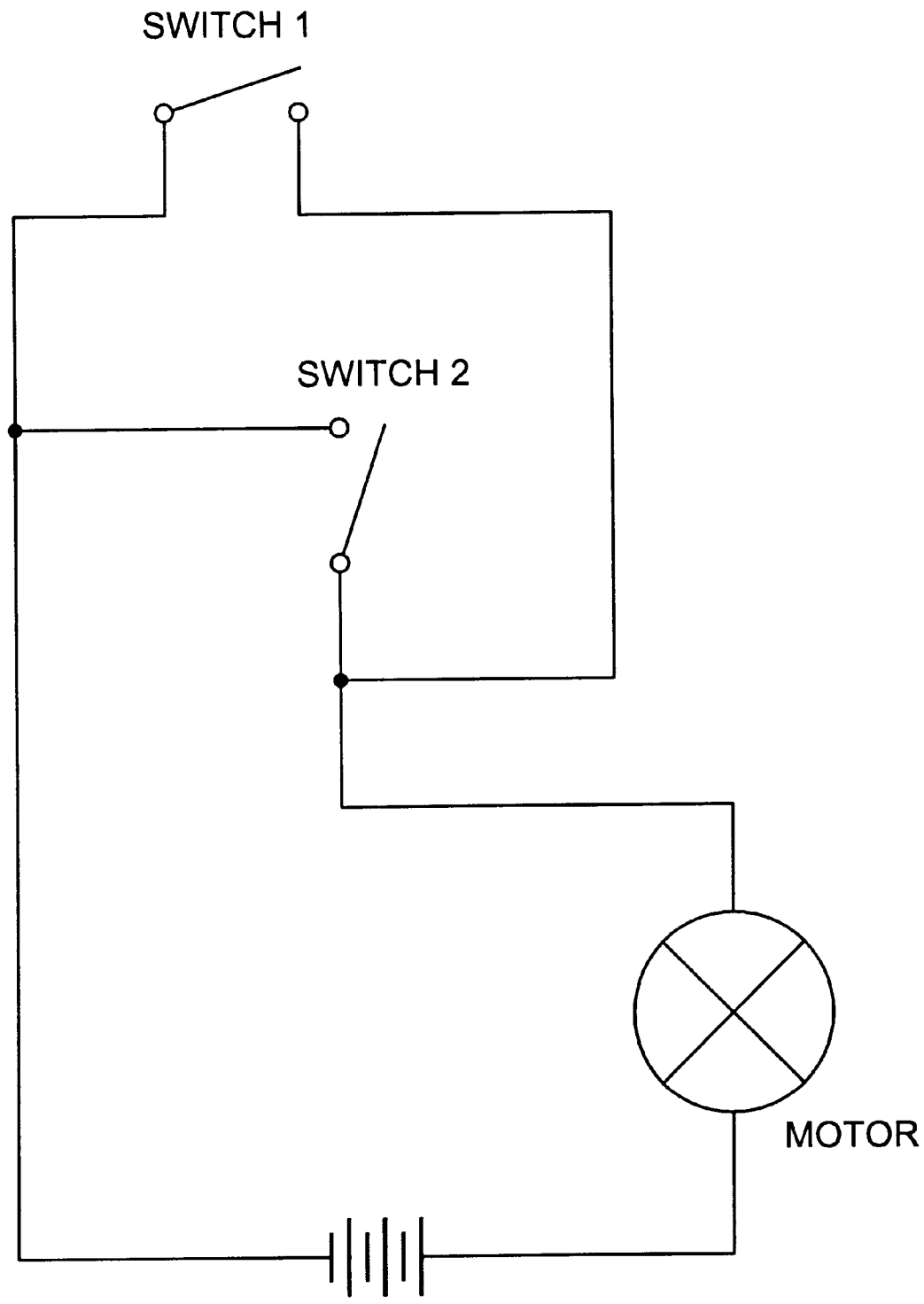

With reference again to FIG. 7, a speaker 146 can be mounted on the housing 10. The speaker 146 is located directly behind the speaker apertures 22 illustrated in FIG. 1. Electrically connected to the speaker 146 is a voice chip 148 (FIG. 10). The control chip 80 selectively activates the voice chip 148, and hence, the speaker. Alternatively, operation could be controlled more simply by an off switch and an on switch as illustrated in FIG. 12. Preferably, the operation of the speaker is coordinated with the rotation of the belts 94 and 96. The speaker can be actuated during the time when the currency is pulled into the housing and the shredded currency is moving past the window. In one embodiment, the speaker broadcasts the message: "ha, ha, ha . . . easy come, easy go." It is evident that the speaker 146 could broadcast whatever message is encoded in the voice chip 148.

With reference again to FIG. 6, a respective protrusion or bump 150, 152 is provided on each of the belts 94 and 96.

Figure 11A:
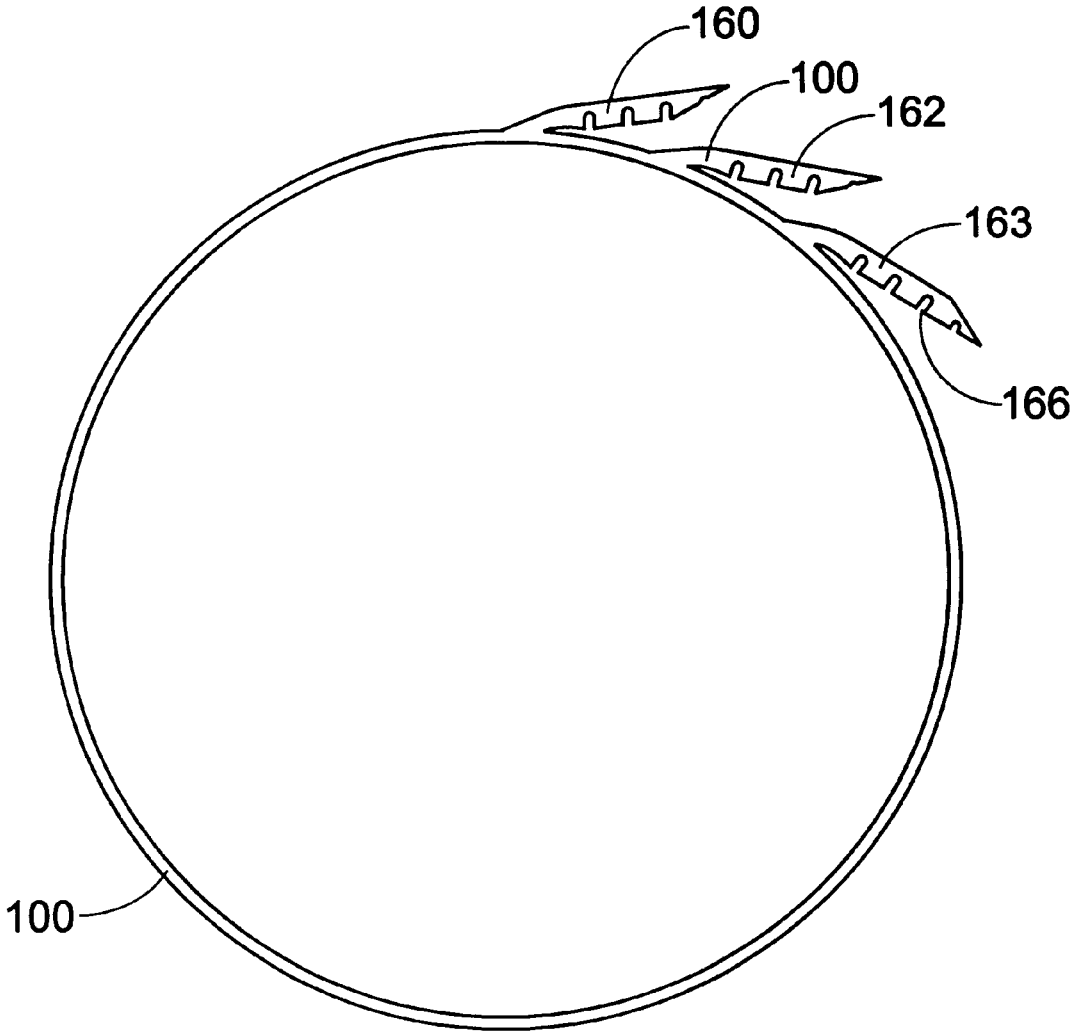
FIG. 11A is an enlarged side elevational view of the belt of the currency bank of FIG. 6.
Figure 11B:
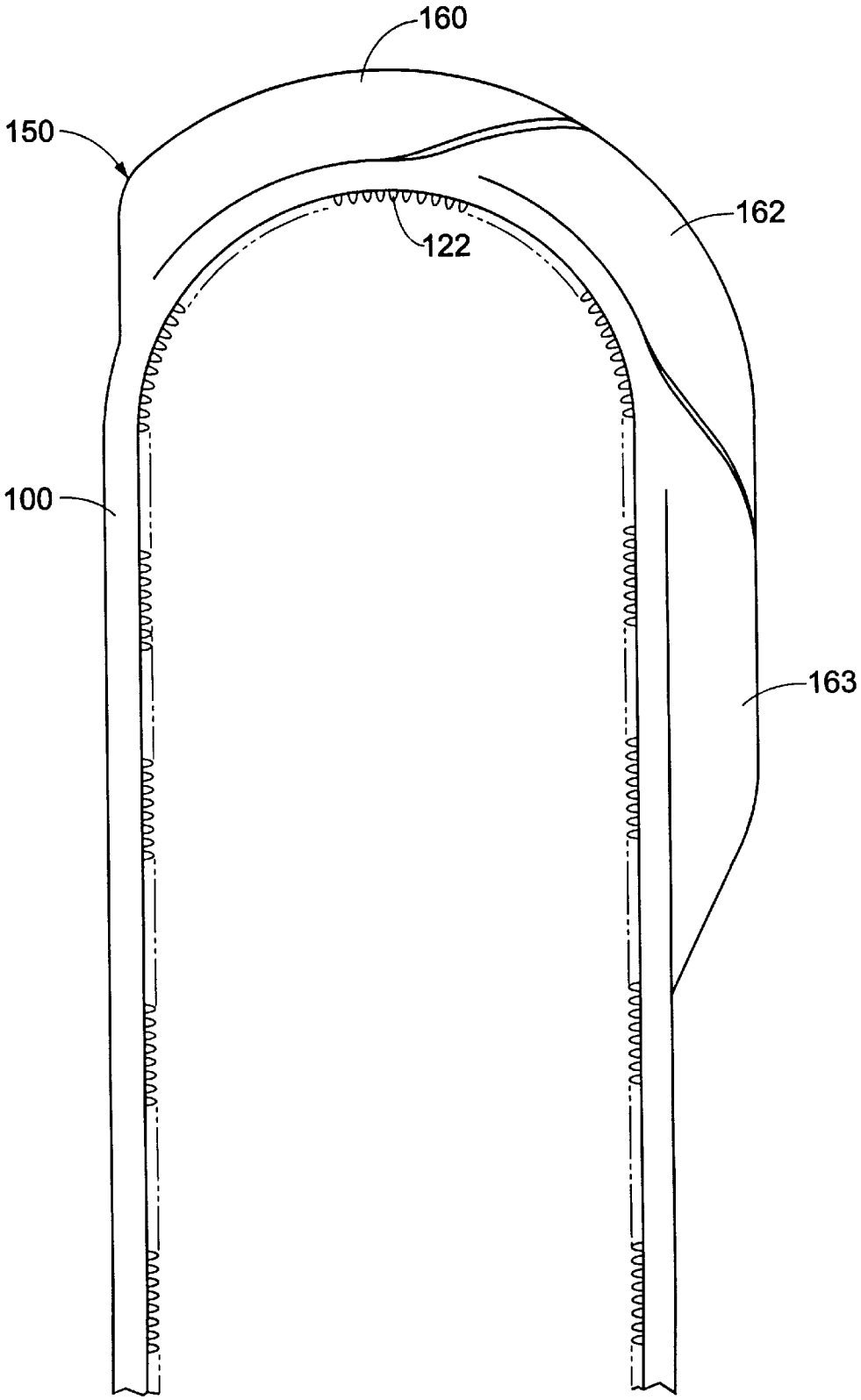
FIG. 11B is a greatly enlarged side elevational view of a portion of the belt of FIG. 11A; and, FIG. 12 is a circuit diagram of another control assembly for the currency bank according to the present invention.

In one preferred embodiment, the bump 150 comprises a pair of spaced elements. With reference now particularly to FIGS. 11A and 11B, the bump 150 can comprise a first element 160 and, slightly spaced therefrom, a second element 162 and a third element 163. The first element 160 serves a timing function and sends an initial signal to the control chip 80 when it activates a second switch 164 (FIG. 10) to stop rotation of the motor. The second and third elements 162 and 163 serve as a means for spacing the front and rear rollers 82 and 84 away from each other. This is done by the bumps pushing the pusher plate 86, and hence the rear rollers 84, away from the front rollers, against the bias of the spring which urges the upper end of the pusher plate 86 forward. Also, the second bump element 162 holds the bill shaft 100. A plurality of slits 166 is cut into the underside of the several bump elements in order to allow the elements to flex as the belt 90 travels around the upper and lower gears 90, 92. This is best shown in FIG. 11B. It should be apparent to those in the art that a single long element bump could be employed instead of the two element design illustrated in FIGS. 11A and 11B.

As mentioned, the bumps serve a timing function. Also serving a timing function is the front finger 74 (FIG. 3). The front finger serves as a first timing element, whereas the bumps 150, 152 serve as a second timing element in controlling the operation of the motor, and hence, the currency bank.

Figure 9:
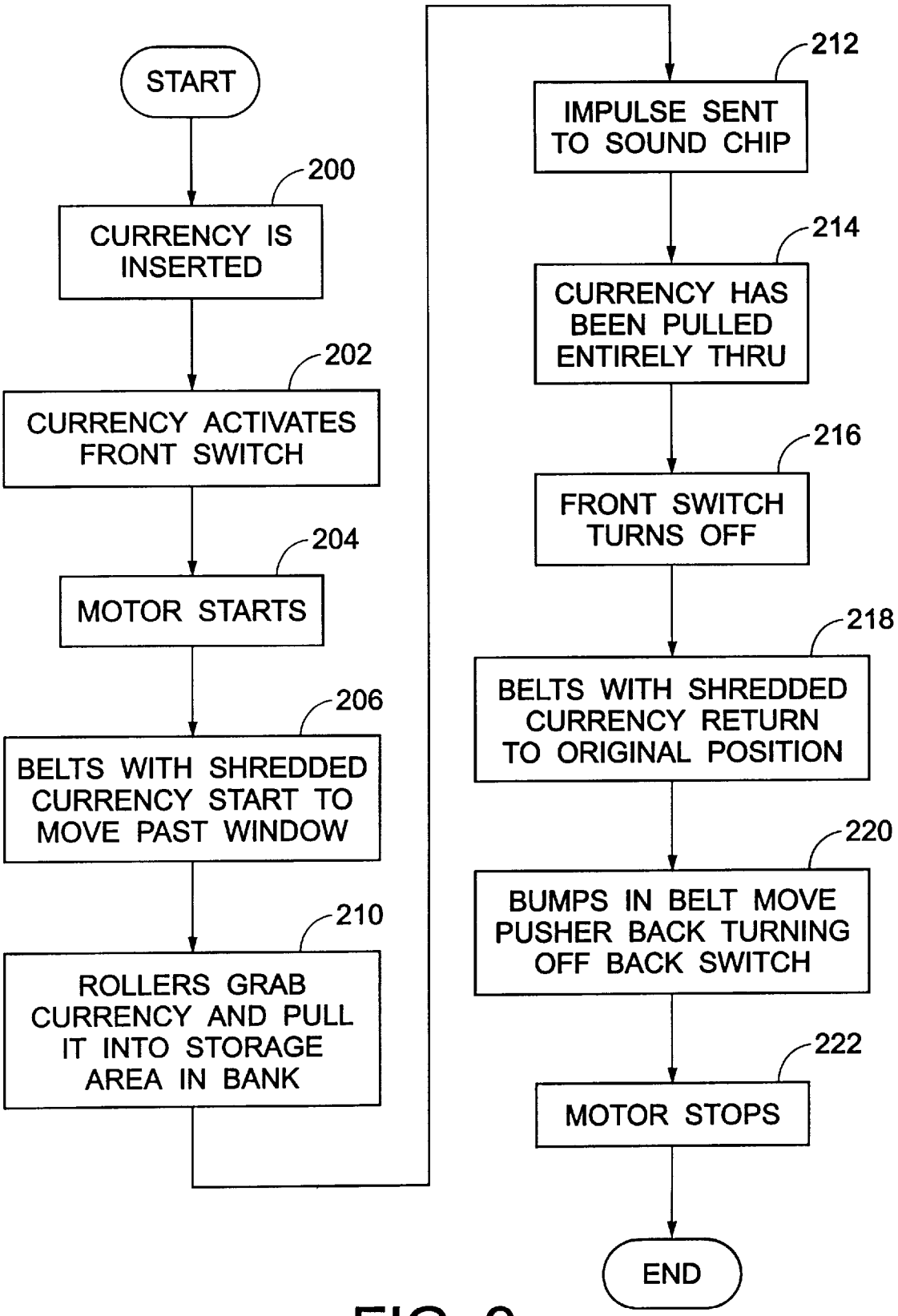
FIG. 9 is a flow chart illustrating the steps performed by the currency bank of FIG. 1.

With reference now to FIG. 9, the operation of the currency bank will now be described. Operation begins when a piece of currency, such as the bill 142, is inserted into the housing 10. A proximal edge of the bill activates the front switch 78 by a movement of the front finger 74. When the front switch is activated, a signal is sent to the control chip 80 which then starts the motor 110 as is illustrated in block 204. The belts 94 and 96 then begin to move past the window 40 as is illustrated in block 206. The rollers 82 and 84, since they form a nip, grab the currency 142 and pull it into the currency storage area 140. At the same time, the shredded currency 102 travels past the window 40. This coordinated movement simulates the shredding of the currency 142 to the observer whereas, in reality, the currency is being preserved.

During the time when the shredded currency 102 is moving past the window and the currency 142 is being taken into the housing 10, an impulse is sent to the voice chip 148 on the circuit board thereby activating the speaker 146 as shown in box 212. Subsequently, the currency is pulled entirely through the front and rear rollers 82 and 84 and is deposited into the storage area 140 as shown in block 214. Thereafter, the front switch 78 turns off as shown in block 260. At this time, the belts 94 and 96 with the shredded currency 102 return to their original position as shown in block 218. The bumps 150 and 152 on the pair of belts 94 and 96 move the pusher 86 back, against the biasing of the spring, turning off the back switch 164 as shown in block 220. More importantly, the bumps keep the front and rear rollers separated. Such separation is necessary in order that a nip is formed by the facing rollers when a piece of currency is inserted between the rollers and trips the front switch. This action brings the opposed rollers together grabbing the currency and preventing its removal. When the back switch is off, the motor 110 stops as shown in block 222. This brings the process to an end.

The main housing 52 and the pusher plate 86 cooperate to define a screen behind the window 20. In this way, the shredded currency 102 can not be seen as it is moved along the belts 94, 96 behind the picture 42 back to the start position of the shredded currency.

The invention has been described with reference to several preferred embodiments. Obviously, modifications and alterations will occur to others upon a reading and understanding of the preceding detailed description. It is intended that the invention be construed as including all such modifications and alterations insofar as they come within the scope of the appended claims or the equivalence thereof.

What is claimed is:

1. A currency bank comprising:

a housing having an inlet and an opening;

a shredded currency mechanism located in said housing and traveling along a first path to selectively appear in said opening;

a feed mechanism for feeding an associated currency into said housing at said inlet;

a second path defined in said housing along which the associated currency travels in said housing, said second path being spaced from said first path; and, a timing assembly for activating said shredded currency mechanism when said feed mechanism is activated so that it appears that the associated currency being fed into the housing is being shredded.

2. The currency bank of claim 1 wherein the timing assembly moves a previously shredded currency of said shredded currency mechanism at a speed which is substantially the same speed as a speed with which the feed mechanism moves the associated currency.

3. The currency bank of claim 1 wherein said shredded currency mechanism comprises:

a motor;

a lower gear train coupled to said motor; and, a belt assembly operatively connected to said gear train wherein said belt assembly comprises:

a pair of belts; and, a plurality of gears around which said pair of belts is looped.

4. The currency bank of claim 3 wherein said plurality of gears comprises:

a spaced upper pair of gears mounted on a first common shaft; and, a spaced lower pair of gears mounted on a second common shaft.

5. The currency bank of claim 3 wherein said shredded currency mechanism further comprises:

a cross bar connected to said pair of belts; and, a shredded currency element secured at one end to said cross bar.

6. The currency bank of claim 3 wherein said motor comprises an electric motor and further comprising a source of electric power for said motor.

7. The currency bank of claim 6 wherein said housing comprises a battery compartment and said source of electric power comprises at least one battery.

8. The currency bank of claim 1 further comprising a speaker located in said housing and wherein said timing assembly activates said speaker.

9. The currency bank of claim 1 further comprising a photograph holder located on said housing.

10. The currency bank of claim 1 further comprising a currency compartment located in said housing and communicating with said second path for holding the associated currency after it has passed through said feed mechanism and along said second path and a door located on said housing for providing access to said currency compartment.

11. The currency bank of claim 1 further comprising an opaque screen located behind said opening in said housing.

12. The currency bank of claim 1 wherein said timing assembly comprises:

a control circuit;

a first timing element for actuating said feed mechanism; and, a second timing element for deactivating said shredded currency mechanism.

13. A currency bank comprising:

a housing;

a shredded currency mechanism located in said housing and traveling along a first path;

a feed mechanism for feeding an associated currency into said housing, the associated currency traveling along a second path in said housing, said second path being spaced from said first path;

at least one motor for powering said shredded currency mechanism and said feed mechanism; and, a timing assembly for activating said shredded currency mechanism when said feed mechanism is activated by the associated currency so that it appears that the associated currency being fed into the housing is being shredded.

14. The currency bank of claim 13 wherein said shredded currency mechanism comprises:

a gear train coupled to said at least one motor; and, a belt assembly operatively connected to said gear train.

15. The currency bank of claim 14 wherein said belt assembly comprises:

a pair of endless belts; and, a plurality of gears around which said pair of endless belts is looped for positively driving said pair of endless belts.

16. The currency bank of claim 15 wherein said plurality of gears comprises:

a spaced upper pair of gears mounted on a first common shaft; and, a spaced lower pair of gears mounted on a second common shaft.

17. The currency bank of claim 15 wherein said shredded currency mechanism further comprises:

a cross bar connected to said pair of endless belts; and, a shredded currency element secured at one end to said cross bar.

18. The currency bank of claim 13 further comprising:

a currency compartment located in said housing and communicating with said second path for holding the associated currency after it has passed through said feed mechanism and traveled along said second path; and, a door located on said housing for providing access to said currency compartment.

19. The currency bank of claim 13 wherein said timing assembly comprises:

a first timing element for actuating said feed mechanism; and, a second timing element for deactivating said shredded currency mechanism.

20. The currency bank of claim 19 wherein said first timing element comprises a finger located in a currency inlet slot of said housing.

21. The currency bank of claim 19 wherein said second timing element comprises a protrusion located on an element of said shredded currency mechanism.

22. A method of operating a currency bank comprising the steps of:

providing a housing having an inlet and a currency compartment;

feeding a piece of currency into the inlet;

moving a previously shredded currency element past an opening in said housing and along a first path;

directing the piece of currency along a second path spaced from the first path; and, depositing the piece of currency into the currency compartment.

23. The method of claim 22 further comprising the step of playing an audio signal during said step of feeding a piece of currency.

24. The method of claim 22 wherein said step of feeding a piece of currency comprises the subsidiary steps of:

contacting an edge of the piece of currency with a finger mounted at the inlet of the housing; and, pulling the piece of currency into the housing.

25. A document holder comprising:

a housing having an inlet and an opening;

a previously shredded sheet medium mechanism located in said housing and traveling along a first path to selectively appear in said opening;

a second path defined in said housing along which an associated intact sheet medium travels in said housing from said inlet, said second path being spaced from said first path; and, a timing assembly for activating said previously shredded sheet medium mechanism when the associated intact sheet medium enters said housing inlet so that the associated intact sheet medium entering said housing appears to be in the process of being shredded.

26. The document holder of claim 25 wherein said previously shredded sheet medium mechanism comprises:

a motor;

a lower gear train coupled to said motor; and, a belt assembly operatively connected to said lower gear train wherein said belt assembly comprises:

a pair of belts, and, a plurality of gears around which said pair of belts is looped.

27. The document holder of claim 26 wherein said plurality of gears comprises:

a spaced upper pair of gears mounted on a first common shaft; and, a spaced lower pair of gears mounted on a second common shaft.

28. The document holder of claim 26 wherein said previously shredded sheet medium mechanism further comprises:

a cross bar connected to said pair of belts; and, a previously shredded sheet medium element secured at one end to said cross bar.

29. The document holder of claim 26 wherein said motor comprises an electric motor and further comprising a source of electric power for said motor.

30. The document holder of claim 25 further comprising an opaque screen located behind said opening in said housing.

31. The document holder of claim 25 further comprising a sheet medium holding compartment located in said housing for holding the associated intact sheet medium after it has passed along said second path and a door located on said housing for providing access to said sheet medium holding compartment.

32. The document holder of claim 25 further comprising a feed mechanism located in said housing adjacent said inlet thereof for feeding the associated intact sheet medium into said housing.

* * * * *